United States Patent [19]

Bach

[11] 4,034,671

[45] July 12, 1977

[54] METHOD OF USING AN OFFSET LITHOGRAPHIC COMBINATION MASTER BLANKET SHEET

[75] Inventor: Frederick O. Bach, Villa Park, Ill.

[73] Assignee: A. B. Dick Company, Chicago, Ill.

[21] Appl. No.: 708,183

[22] Filed: July 23, 1976

Related U.S. Application Data

[62] Division of Ser. No. 540,590, Jan. 13, 1975, abandoned.

[51] Int. Cl.[2] ..... B41M 1/06; B41C 1/10

[52] U.S. Cl. ..... 101/451; 101/401.1; 101/426; 101/454; 101/460; 428/909

[58] Field of Search ..... 101/450, 451, 454, 460, 101/426, 401.1; 428/909

[56] References Cited

U.S. PATENT DOCUMENTS

| | | | |
|---|---|---|---|
| 2,020,479 | 11/1935 | Sites | 101/460 |
| 2,042,003 | 5/1936 | Huebner | 101/466 |
| 2,048,964 | 7/1936 | Osborn | 101/462 |
| 2,129,071 | 9/1938 | Rowell | 101/466 |
| 2,178,259 | 10/1939 | Kjell | 101/123 |
| 2,348,943 | 5/1944 | Wescott | 101/460 |

*Primary Examiner*—Clyde I. Coughenour
*Attorney, Agent, or Firm*—Peter S. Lucyshyn

[57] ABSTRACT

A combination master/blanket printing sheet for use with a lithographic offset duplicating press includes a master layer comprising material having hydrophilic properties which is imagable to provide pre-selected oleophilic areas for receipt of printing inks and a blanket layer of hydrophobic-oleophilic material suitable for receiving and carrying thereon an inked image transferred thereto by contact with a member carrying such image. In a preferred embodiment of the printing sheet the master and blanket layers are applied by coating or other suitable techniques to opposite surfaces of a base or support layer. The printing sheet is usable in the offset printing process both as a "master" sheet, when properly imaged on the master layer, and a "blanket".

2 Claims, 3 Drawing Figures

METHOD OF USING AN OFFSET LITHOGRAPHIC COMBINATION MASTER BLANKET SHEET

This is a division, of application Ser. No. 540,590, filed Jan. 13, 1975 now abandoned.

BACKGROUND OF THE INVENTION

This invention relates generally to offset lithography and more particularly to a disposable combination master/blanket sheet for use in the process.

In an offset lithographic duplicating press of the conventional type, there is provided master, blanket and impression cylinders all mounted for rotation. The master and impression cylinders are positioned for contacting engagement with the blanket cylinder. An imaged master sheet is attached by means of a mechanical clamp of the like device to the outer surface of the master cylinder. Ink applied to the master is received in the oleophilic imaged areas. As the master and blanket cylinders rotate, the inked image is transferred to the surface of the blanket cylinder. Conventionally, the blanket cylinder is covered with a rubber or the like ink receptive (oleophilic) material known as the blanket.

Paper fed between the blanket and impression cylinders receives the inked image from the blanket to complete the printing process.

After the completion of a run wherein a predetermined number of copies are printed, the master sheet is discarded. This can be accomplished manually or in some cases automatically. Also, the blanket must be washed every time a master is discarded to remove any ink remaining thereon. This is normally accomplished by the application of a solvent. In the latter case, the operation of the duplicating press must be discontinued while the clean-up process takes place. Also, the clean-up process can become messy.

In an attempt to minimize the need for cleaning up the blanket and to reduce the "down time" of the duplicating press, it has been suggested to provide a disposable blanket consisting of a foam plastic sheet or paper sheet having a rubber or rubber-like coating thereover. This sheet is mounted on the blanket cylinder similarly to the attachment of a sheet to the master cylinder and upon completion of a copy run is discarded along with the master.

While the provision of the disposable blanket simplifies somewhat the duplicating process by eliminating the need for a solvent wash, it has the disadvantage that at the conclusion of each printing run, both a master and blanket sheet must be discarded. This can become costly. Furthermore, it becomes necessary to purchase and store both master and blanket sheets to carry out the process.

SUMMARY OF THE INVENTION

Accordingly, it is a primary object of the present invention to provide a new and improved lithographic printing sheet which avoids the need for discarding and storing separate master and blanket sheets as required in the prior art.

It is a further object of the present invention to provide a single printing sheet which can be used both as a master and a blanket, which is relatively simple in construction and relatively low in cost.

It is still another object of the present invention to provide a new and improved method for carrying out the lithographic printing process using a printing sheet according to the invention which eliminates the need for cleaning up the cylinder of the machine after each copy run and minimizes the down time of the machine.

Briefly, a preferred offset combination master/blanket printing sheet accordng to the invention includes a base layer comprising a support material, such as paper, metal foil, plastic or the like. Coated on one surface thereof is a hydrophilic layer or a layer which can be rendered hydrophilic and which can be selectively imaged using common imaging techniques. Suitable coatings of the last-mentioned type are insolubilized binders such as zinc polyacrylate, starch or alginate in combination with pigments which render the coating hydrophilic or resin binders in combination with zinc oxide or other photoconductive pigments.

On the opposite surface of the base layer there is provided a backing or blanket coating of hydrophobic-oleophilic material, such as rubber, silicon rubber, wax or resin.

in use, the hydrophilic or master layer is imaged by typing, writing, electrophotography or the like. The sheet is mounted by means of the usual clamp(s) on the master cylinder of a duplicating machine with the master layer of the sheet exposed. A second combination master/blanket sheet is attached in a similar manner to the blanket cylinder by a clamp or the like means provided thereon with the backing or blanket surface exposed. Thereafter, the printing process is commenced. Upon completion of the printing process, the master and blanket sheets are removed from respective cylinders and the original master sheet is reattached to the blanket cylinder with the backing or blanket surface of the sheet being exposed. The original blanket sheet can be discarded or if desired saved for use as a master sheet. The latter process continues so that after at least two copy runs, a single combination master/blanket sheet according to the invention will have been used twice; i.e., once as a master sheet and once as a blanket sheet.

DETAILED DESCRIPTION

Figure 1:
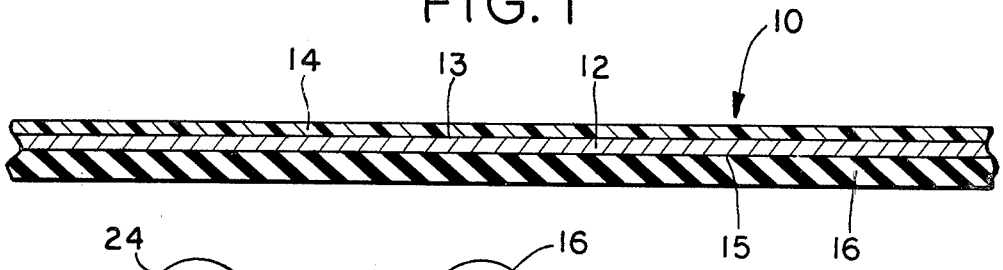
FIG. 1 is a cross sectional view of a combination master/blanket sheet according to the invention.

Referring now to the drawing in greater detail, a preferred embodiment of the combination master/blanket sheet 10 according to the invention includes a base layer 12, herein shown as the center layer of the sheet. The base layer is fabricated from suitable support materials, such as, for example, paper, metal foil or plastic, such as polystyrene, mylar and the like.

A second, master layer 14 is applied preferably by coating onto one surface 13 of the base layer. The layer can take the form of an insolubilized binder material such as, for example, zinc polyacrylate, starch or alginate in combination with pigments such as titanium dioxide, coating clays, aluminum silicate, talc or the like, used to make the surface hydrophilic. The material can also be a resin binder in combination with zinc oxide or other photoconductive pigments which can be rendered hydrophilic during the imaging process. In the first example, the master layer is of the type which can be imaged by conventionally used typing, writing, xerographic or the like techniques wherein the oleophilic image material is selectively deposited on the hydrophilic layer. In the second example, one can image the master through the electrophotographic process, wherein the oleophilic image material is deposited directly onto the layer and thereafter the layer is passed through a solution to render all but the imaged areas hydrophilic. For the purpose of this invention, the term "hydrophilic properties" shall be used to describe both master layers which are hydrophilic initially, such as zinc polyacrylate, etc., and those which can be made hydrophilic by application of suitable treatment, such as zinc oxide and the like.

The third layer 16 comprising a backing or blanket layer is applied to the opposite surface 15 of the base layer 12. The blanket material is hydrophobic and oleophilic and can take the form of rubber or rubber-like material, such as neoprene, silicon rubber, wax or resin material similar to the materials conventionally employed for fabricating a blanket surface on the blanket cylinder of a duplicating machine. The backing layer may also be pigmented if desired to render it properly ink receptive. The backing layer may be applied to the base layer by any suitable process, such as, for example, coating or laminating. The combination master/-blanket sheet according to the invention may also take the form of a two layer sheet wherein the base layer comprises a plastic or the like support layer. In this case the base layer must be oleophilic-hydrophobic. The base layer is coated with a layer having hydrophilic properties. The last-mentioned layer serves as the master sheet layer, while the plastic layer serves as both a support and blanket layer. To provide the desired resiliency to the blanket layer, a conventional blanket cylinder having a layer of rubber or the like material thereon may be used with the combination master/blanket sheet according to the invention.

Coating methods which may be used in applying the master and/or blanket layers to a base layer of the printing sheet 10 according to the invention are conventional reverse roll, wire wound rod and trailing blade techniques. In the case of the application of a blanket layer comprising silicon or neoprene rubber, sheet stock of these materials can be laminated directly onto the surface of the base layer.

Figure 2:
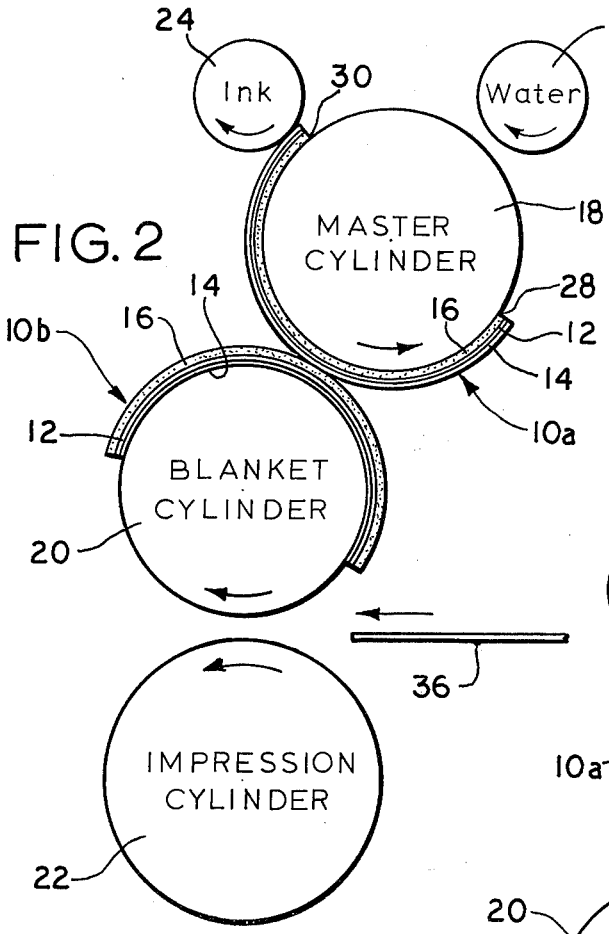
FIGS. 2 and 3 are diagrammatical representations of an offset duplicating machine used to illustrate the use of the combination master/blanket sheet in the lithographic printing process according to the invention.
Figure 3:
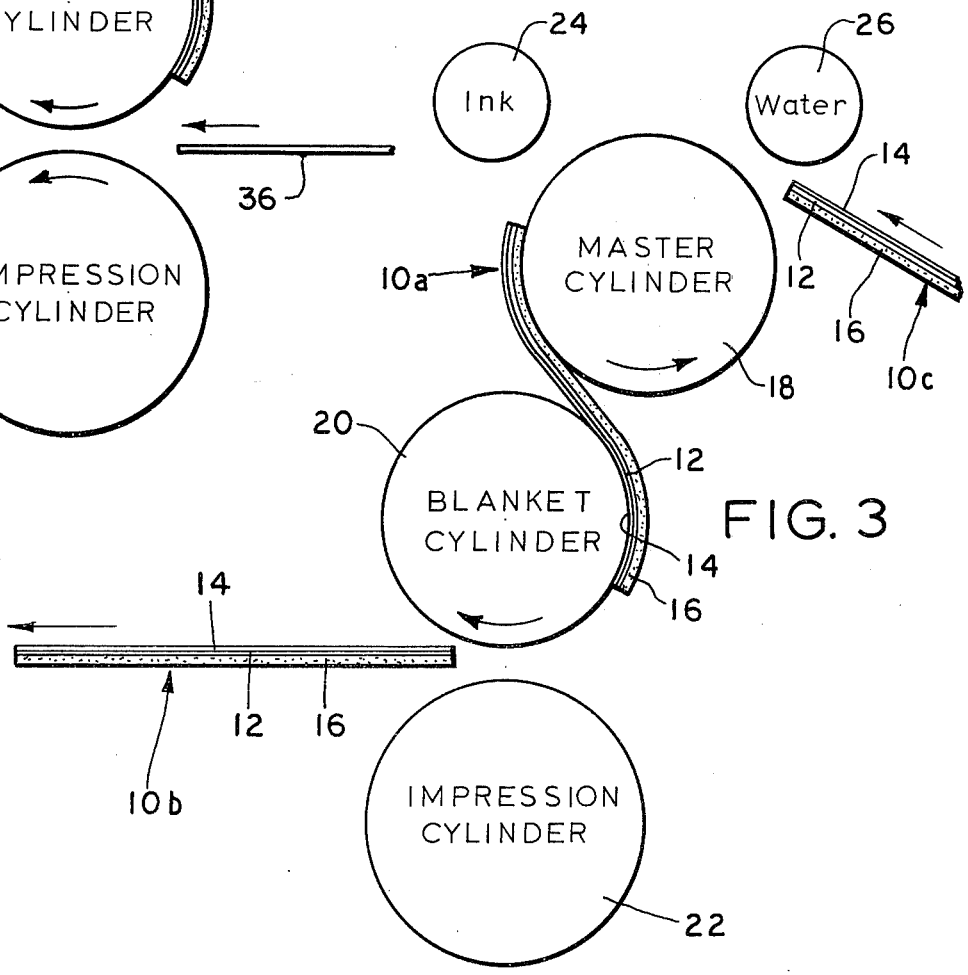

Referring now to FIGS. 2 and 3 of the drawing, there is illustrated therein in diagrammatical form, the essential elements of an offset duplicating press. The press includes a master cylinder 18 mounted for rotation in the direction of the arrow (counterclockwise as shown), a blanket cylinder 20 mounted for rotation in the opposite direction (clockwise as shown) in contacting engagement with the master cylinder and an impression cylinder 22 mounted for rotation also in the direction of the arrow (counterclockwise as shown) in contacting engagement with the blanket cylinder.

Form rollers 24, 26, respectively, are provided for applying ink and water, respectively, from suitable sources (not shown) to a master sheet 10*a* attached to the surface of the master cylinder during the printing process.

To make use of the combination master/blanket sheet according to the invention, a first sheet 10*a* which has been imaged on the master layer 14 thereof by common imaging techniques of the type described heretofore, is mounted on the outer surface of the master cylinder 18, with the master layer 14 of the sheet being exposed. The sheet is held on the cylinder surface by means of clamps or the like (not shown) provided at one or both of the opposite ends 28, 30 of the sheet.

A second sheet 10*b* is mounted in a similar fashion to the blanket cylinder 20; the blanket layer 16 of the sheet 10*b* being exposed.

The duplicating machine is then operated to rotate the cylinders in the directions shown. As the cylinders rotate, ink and water or other moisturizing liquid are applied to the master layer of sheet 10*a* in a conventional fashion, the ink being received at the imaged areas while the water coats the non-imaged areas. Continued rotation of the cylinders causes the master layer 14 of the master sheet 10*a* to engage the blanket layer 16 of the second, blanket sheet 10*b* so that an inked image is transferred to the last-mentioned layer.

As the blanket cylinder rotates, the image is transferred to copy sheets, such as 36, which are fed from a suitable source (not shown) into the nip of the blanket and impression cylinders in synchronization with the movement of the blanket sheet 10*b*, to receive an inked image thereon.

Upon completion of a copy run; i.e., after a desired number of copies have been printed with the imaged master, the original blanket sheet 10*b* is removed from the blanket cylinder 20. The original master sheet 10*a* is removed from the master cylinder and attached to the empty blanket cylinder with the blanket layer 16 thereof now being exposed.

A third combination master/blanket sheet 10*c* is, after being imaged as described heretofore, then attached to the master cylinder with the master layer 14 thereof being exposed. At this time, the printing process can begin again using the newly imaged master sheet 10*c*.

In FIG. 3 of the drawings the advancement of the various combination master/blanket sheets 10*a*, 10*b*, 10*c* to their respective positions subsequent to the printing of the desired number of copies with master sheet 10*a*, is shown. This process of advancement can be automated if desired or can be carried out manually. Different methods and apparatus for automating the advancement of the sheets may be employed. Some of these methods and apparatus will be obvious to one skilled in the art.

In using the combination master/blanket sheets as described in the first instance, sheet 10*b* is discarded without having been used as a master sheet. Normally this will be the case because of the ink remaining on the blanket layer 16 thereof. However, it is possible that the remaining ink can be removed and the sheet thereafter be used as a master sheet. Furthermore, upon the master sheet 10*a* being attached to the blanket cylinder for use as a blanket sheet, ink will be transferred from the master layer 14 of the sheet 10*a* to the surface of the blanket cylinder. This ink will not affect the attachment of the master sheet to the blanket cylinder nor cause slipping of the sheet during the subsequent printing process. It should be noted, however, that a buildup of ink may occur on the blanket cylinder surface after repeated runs with many masters. This ink can, however, be removed from time-to-time from the cylinder surface in the conventional manner.

As can be seen from the above description, using the combination master/blanket sheet according to the invention permits successive runs of copies to be made using different imaged master sheets, while minimizing the need for cleaning from the blanket cylinder surface as well as avoiding the necessity to purchase and store a variety of sheets for use on the lithographic duplicator press.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What I claim is:

1. A method of printing with ink on copy sheets in a lithographic offset duplicating press including master, blanket and impression cylinders mounted for rotation, the master and impression cylinders being substantially in contacting engagement with the blanket cylinder, comprising the steps of:

providing a first combination master/blanket sheet having a master layer comprising material having hydrophilic properties and a blanket layer of hydrophobic-oleophilic material, said master layer being predeterminedly imaged to provide a pattern of oleophilic areas for receipt thereat of printing inks;

mounting said first sheet onto the surface of said master cylinder with said imaged master layer being exposed;

providing a second combination master/blanket sheet having a master layer comprised of material having hydrophilic properties and a blanket layer of hydrophobic-oleophilic material;

mounting said second sheet onto the surface of said blanket cylinder with said blanket layer being exposed;

applying ink and water to the master layer of said first sheet whereby said imaged areas are inked and transferred to the blanket layer of said second sheet;

feeding copy sheets into the nip of said impression and blanket cylinders to print said inked image on the sheet surfaces as they pass between the rotating impression and blanket cylinders;

after completion of a copy run, removing said blanket and master sheets from respective cylinders; and mounting said first sheet to said blanket cylinder with the blanket layer thereof being exposed for a subsequent copy run.

2. A method of printing with ink on copy sheets in a lithographic offset duplicating press including master, blanket and impression cylinders mounted for rotation, the master and impression cylinders being substantially in contacting engagement with the blanket cylinder, comprising the steps of:

providing first and second combination master/blanket printing sheets, each having a master layer comprising material having hydrophilic properties which is imagable to provide pre-selected oleophilic areas for receipt of printing inks and a blanket layer of hydrophobic-oleophilic material suitable for receiving and carrying thereon an inked image transferred thereto by contact with a medium carrying such image;

imaging the master layer of a first one of said printing sheets to provide said pre-selected oleophilic imaged areas;

mounting said first printing sheet onto said master cylinder with said imaged master layer being exposed;

mounting said second printing sheet onto the surface of said blanket cylinder with said blanket layer being exposed;

applying ink and water to the master layer of said first printing sheet whereby said imaged areas are inked and transferred to the blanket layer of said second sheet as said cylinders are rotated;

feeding copy sheets into the nip of said impression and blanket cylinders to print said inked image on the sheet surfaces as they pass between the rotating impression and blanket cylinders;

after completion of the printing of a predetermined number of copies, removing both said first and second printing sheets from respective cylinders; and mounting said first sheet to said blanket cylinder with the blanket layer thereof being exposed for a subsequent copy run.

* * * * *